US005436689A

United States Patent [19]

Matsumoto

[11] Patent Number: 5,436,689

[45] Date of Patent: Jul. 25, 1995

[54] PHOTOSENSITIVE MATERIAL PROCESSING APPARATUS

[75] Inventor: Nobuo Matsumoto, Kanagawa, Japan

[73] Assignee: Fuji Photo Film Co., Ltd., Kanagawa, Japan

[21] Appl. No.: 233,899

[22] Filed: Apr. 28, 1994

[30] Foreign Application Priority Data

Apr. 27, 1993 [JP] Japan ..... 5-122129

[51] Int. Cl.[6] ..... G03D 3/08; G03D 13/08

[52] U.S. Cl. ..... 354/321; 354/323; 354/339

[58] Field of Search ..... 354/317-324, 354/339, 340, 338; 134/64 P, 64 R, 122 P, 122 R; 226/90-92, 109, 189

[56] References Cited

U.S. PATENT DOCUMENTS 4,272,000 6/1981 Hope et al. ..... 354/339 X
4,514,071 4/1985 Köninger et al. ..... 354/320

FOREIGN PATENT DOCUMENTS 3921664 7/1939 Japan .
49-6925 1/1974 Japan .
1205166 8/1989 Japan .
214693 4/1990 Japan .

*Primary Examiner*—D. Rutledge
*Attorney, Agent, or Firm*—Sughrue, Mion, Zinn, Macpeak & Seas; Richard C. Turner; Steven M. Gruskin

[57] ABSTRACT

A photosensitive material processing apparatus includes a transport device for transporting an elongated photosensitive material so that the photosensitive material is immersed in respective processing solutions accommodated in a plurality of processing tanks which are serially disposed in an order in which processing is to be performed. A guide device is also provided for guiding the photosensitive material transported by the transport device. The guide device has a plurality of guide members corresponding to a plurality of widths of various types of photosensitive material. Accordingly, a simplified processing apparatus can process various types of photosensitive materials having different widths without attaching any leaders to the photosensitive materials.

18 Claims, 5 Drawing Sheets

PHOTOSENSITIVE MATERIAL PROCESSING APPARATUS

BACKGROUND OF THE INVENTION

1. Field of the Invention

The present invention relates to a photosensitive material processing apparatus which is capable of transporting long, narrow shaped photosensitive materials for processing, without attaching leaders to the photosensitive materials, even in the case in which at least two kinds of photosensitive materials having different widths are processed by a common processing apparatus.

2. Description of the Related Art

Photosensitive materials, after being exposed, are generally subjected to various kinds of processing, such as development, bleaching, fixing, washing, and drying. These processing steps are automatically carried out by using a conveyer system. In an apparatus of this kind, a film which has been drawn out from a magazine by a supply mechanism is passed through a plurality of processing tanks, each having transport means such as transport belts and nip rollers for transporting the film, in the order in which processing is to be performed. Thereafter, the film is dried.

Examples of such conventional photosensitive material processing apparatuses is described below.

(1) Japanese Patent Application Laid-open No. 49-6925 discloses a photosensitive material processing apparatus which is provided with a housing for accommodating all the processing tanks and for shielding the tanks from light and an endless belt which circulates within the housing. A clamping arm having a plurality of small protrusions each having a mushroom-like shape is attached to the endless belt at an opening of the housing provided outside of the light-shielding section. The mushroom-like protrusions are made to pierce photosensitive material such as a film so as to transport the photosensitive material for processing. After processing, the photosensitive material is released from the mushroom-like protrusions at the above-mentioned opening.

(2) Japanese Patent Application Publication No. 2-14693 discloses a photosensitive material processing apparatus which is provided with an endless timing belt for preventing the transport means from carrying a processing solution from an upstream processing tank to a successive downstream processing tank. In this apparatus, a leader attached to the film is caused to engage a plurality of protrusions provided on the outer side of the timing belt so as to transport the film. Also, arcuate guides are provided adjacent to portions of the timing belt which are curved for separating the leader and the film from the timing belt. Since the leader and the film are transported, while being bent, along the arcuate guides, the timing belt is provided in each of the processing tanks.

(3) Japanese Patent Application Laid-open No. 1-205166 discloses a photosensitive material processing apparatus in which a plurality of guide racks are provided in each of the processing tanks so as to guide photosensitive material. Each of the guide racks is equipped with guide width changing means for moving edge guides which contact the transverse edges of the photosensitive material in accordance with the widths of the photosensitive material. A common rotary shaft is supported by the plurality of processing tanks to run across the processing tanks, and a frictional transmission means is disposed between the common rotary shaft and each guide width changing means so that the edge guides in the respective racks are moved in accordance with the width of a photosensitive material to be processed.

(4) Japanese Utility Model Application Publication 39-21664 discloses a photosensitive material processing apparatus in which the lateral movement of each photosensitive material is restricted by guide grooves formed in both side walls of each processing tank so that the front and back surfaces of the photosensitive material are prevented from contacting the transport rollers. Each photosensitive material is transported by transport drive rollers which are provided at given locations along the guide grooves and which contact both side edges of the photosensitive material.

These conventional apparatuses, however, have the following drawbacks or problems. In the prior art device described in paragraph (1), it is necessary to perform the troublesome task of removing a film from the mushroom-like protrusions after processing. In the prior art device described in paragraph (2), it is necessary to perform the troublesome process of attaching a photosensitive material to a leader which is engaged with the timing belt before processing and removing the photosensitive material from the leader after processing. In the prior art device described in paragraph (3), the position changing mechanism, which is provided across all the processing tanks so as to change the positions of the edge guides, has a complicated structure which requires time consuming maintenance and which leads to an increase in production costs of the apparatus. In the prior art device described in paragraph (4), the apparatus itself has a relatively simple structure, but it can process only a single kind of photosensitive material having a particular fixed width because of the fixed distance between the opposing guide grooves.

As described above, when plural kinds of photosensitive materials having different widths are processed by conventional processing apparatuses, there arise problems in that the operation becomes complex, and the structure of the processing apparatuses becomes complicated, resulting in higher production costs.

SUMMARY OF THE INVENTION

In view of the foregoing, it is an object of the present invention to provide an improved photosensitive material processing apparatus which eliminates the necessity of leaders which are conventionally attached to photosensitive materials so as to stabilize their transport during processing, and which is capable of processing plural kinds of photosensitive materials having different widths without using a width adjusting mechanism or the like.

A photosensitive material processing apparatus according to a first aspect of the present invention comprises a plurality of processing tanks serially arranged in an order in which processing is to be performed and accommodating processing solutions respectively, transport means for transporting an enlarged photosensitive material so as to immerse said photosensitive material in each of said processing solutions, and guide means for guiding said photosensitive material transported by said transport means and having a plurality of guide members corresponding to a plurality of widths of photosensitive materials.

According to a second aspect of the present invention, the transport means in the first aspect of the invention is provided in each of the plurality of processing tanks and has a pair of wall portions which oppose each other and at least parts of which are immersed in a processing solution accommodated in the corresponding processing tank. The transport means also has a plurality of transport rollers disposed between the pair of wall portions and axially supported by the pair of wall portions. The wall portions are formed with a plurality of grooves acting as the guide members. The plurality of grooves are formed such that a plurality of transport paths of photosensitive material is marged at a merging portion, and separate into a plurality of grooves at a downstream side of the merging portion.

The pair of wall portions formed with a plurality of grooves corresponding to the widths of the plural kinds of photosensitive materials may be side panels which form transport racks carrying transport rollers or the like, or inner walls of processing tanks. It is preferable that the grooves be continuously extended in the vertical direction to form in the processing tank a forward path and a backward path for the photosensitive material, and also form at the bottom of the processing tank a transitional portion connecting the forward path and the backward path.

According to the first and second aspects of the present invention, there is provided an improved photosensitive material processing apparatus for processing plural kinds of photosensitive materials having different widths in which the photosensitive materials are successively transported to each of processing tanks and are transported in the vertical direction therein, and in which a plurality of guide grooves for guiding both side edges of the photosensitive materials having different widths are formed in a pair of wall portions of the apparatus. The wall portions are formed, for example, by a pair of opposing side panels of transport racks which rotatably support transfer rollers and act as transporting means. The plurality of grooves are continuously formed in the wall portions from the vicinity of the entrance of each processing tank, which is a processing start point, to the vicinity of the exit of the processing tank, which is a processing end point. Generally, apparatuses for feeding photosensitive materials are designed to feed photosensitive materials such that the transverse center of each photosensitive material coincides with the transverse center of the transport rollers or the like. Therefore, the leading end of a photosensitive material having a narrower width is led directly into a pair of opposing guide grooves having a smaller distance or smaller guide width therebetween, and the leading end of a photosensitive material having a wider width is led directly into another pair of opposing guide grooves having a larger distance or larger guide width therebetween. This operation is carried out without attaching leaders to the photosensitive materials. The photosensitive materials are thereafter transported through the processing tank, and are then fed to a subsequent processing tank. Accordingly, troublesome operations such as the attachment and detachment of leaders are not required. In addition, a complicated mechanism having a controller, which is conventionally used for adjusting the distance between each pair of opposing grooves in accordance with the widths of photosensitive materials, is not necessary, thereby reducing the manufacturing costs of the apparatus. Moreover, the maintenance of the apparatus can be simplified because of reduced malfunctions.

DESCRIPTION OF THE PREFERRED EMBODIMENTS

Figure 1:
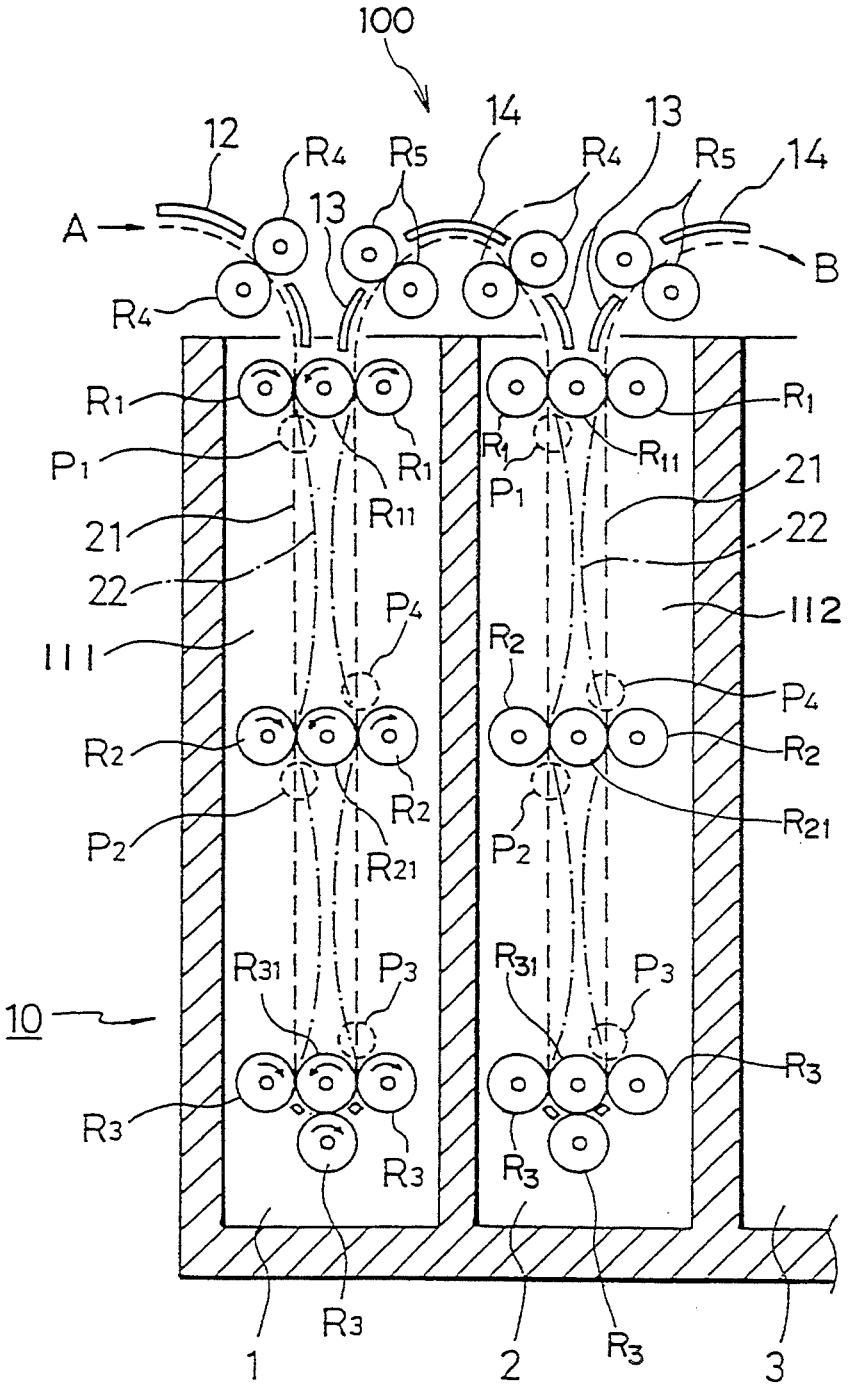
FIG. 1 is a vertical sectional view schematically showing the structure of a major part of a photosensitive material processing apparatus according to a first embodiment of the present invention.
Figure 2:
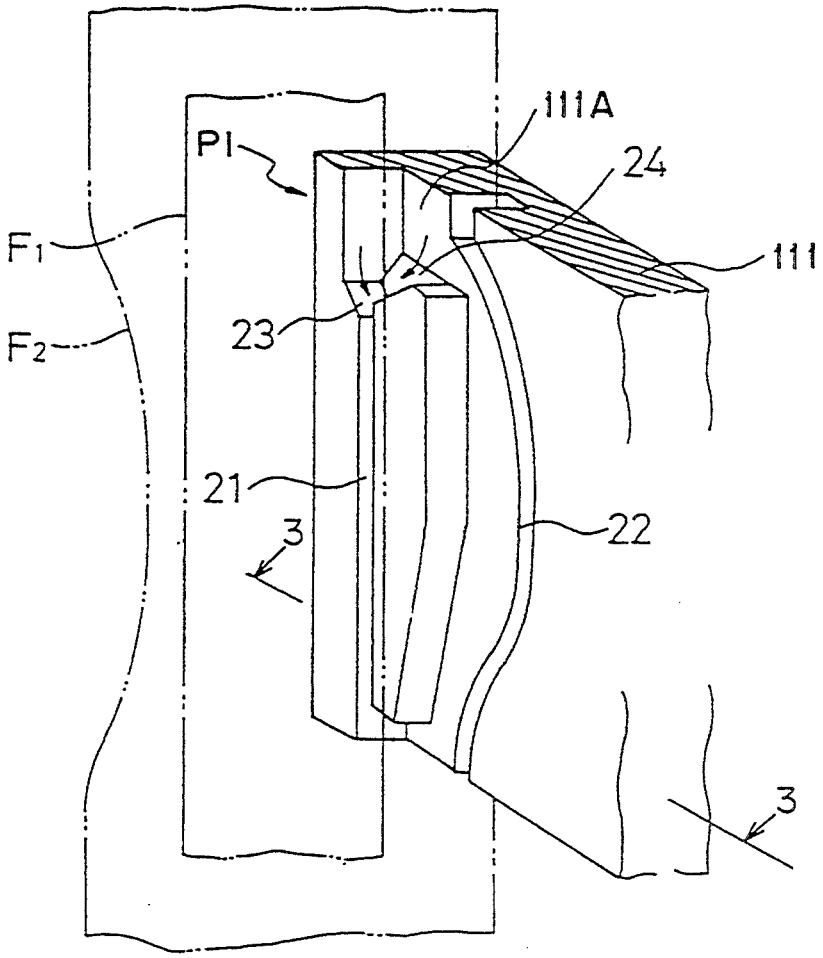
FIG. 2 is a perspective view specifically showing the guide portion provided along the narrow film guide groove in the first embodiment.
Figure 3:
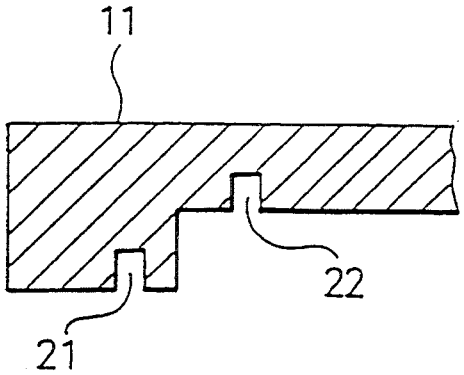
FIG. 3 is a sectional view taken along line 3—3 of FIG. 2.
Figure 4:
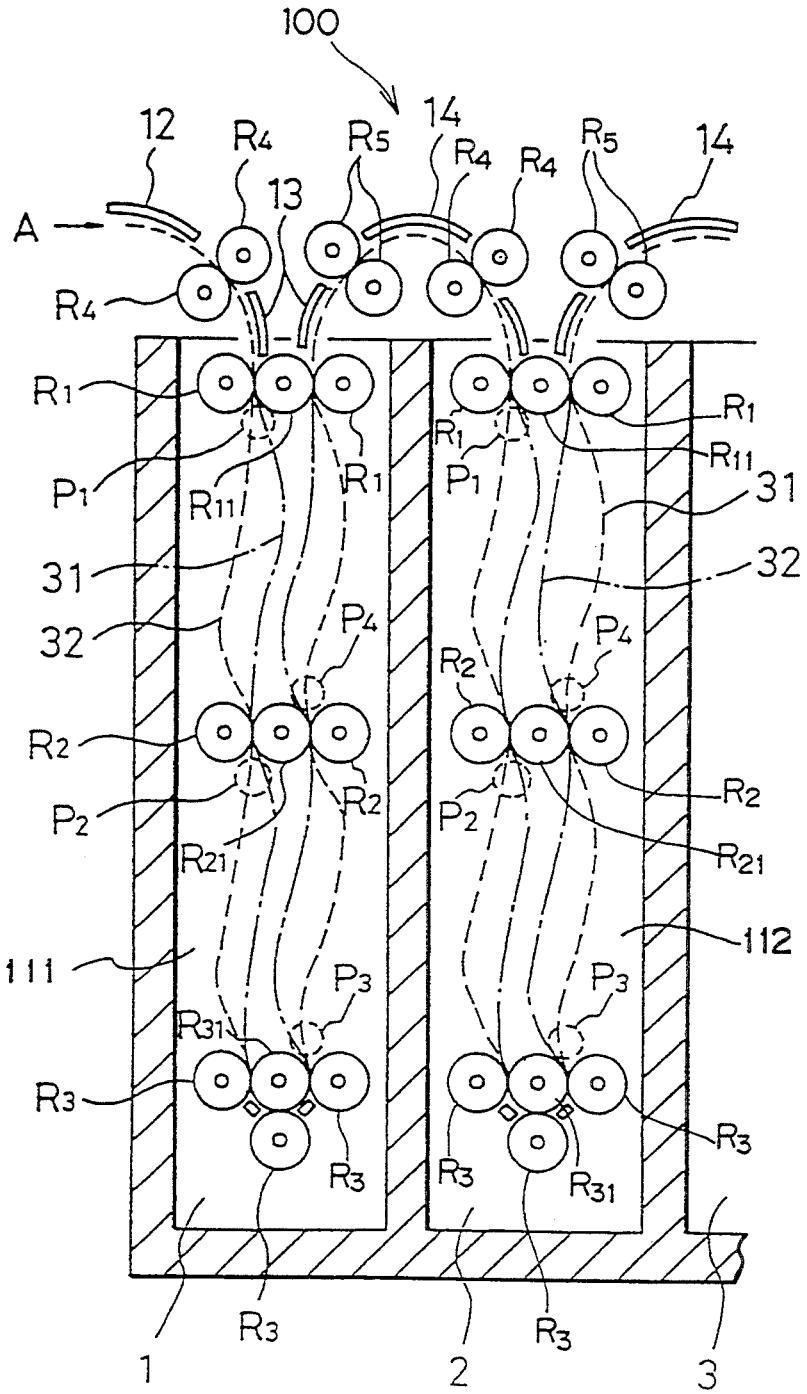
FIG. 4 is a vertical sectional view schematically showing the structure of a major part of a photosensitive material processing apparatus according to a second embodiment of the present invention.
Figure 5:
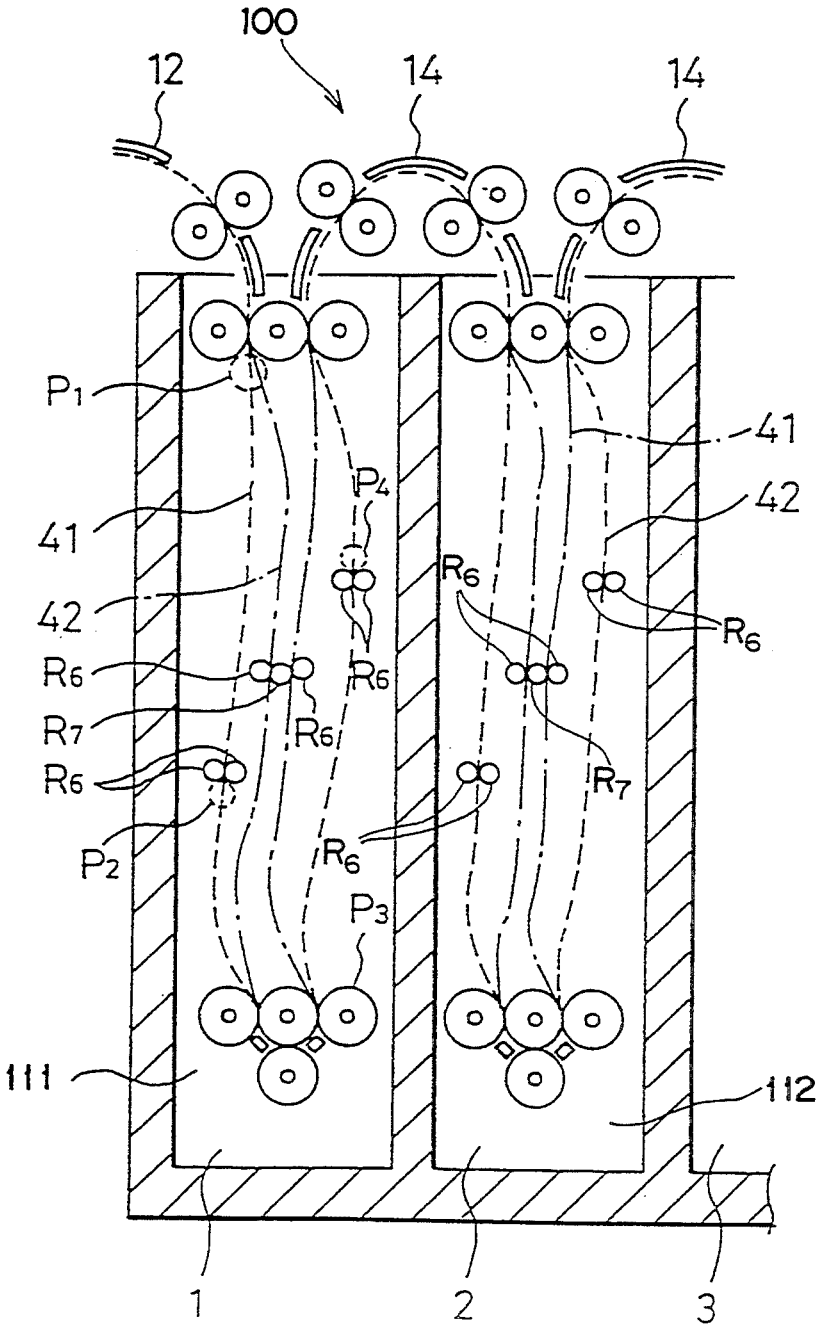
FIG. 5 is a vertical sectional view schematically showing the structure of a major part of a photosensitive material processing apparatus according to a third embodiment of the present invention.
Figure 6:
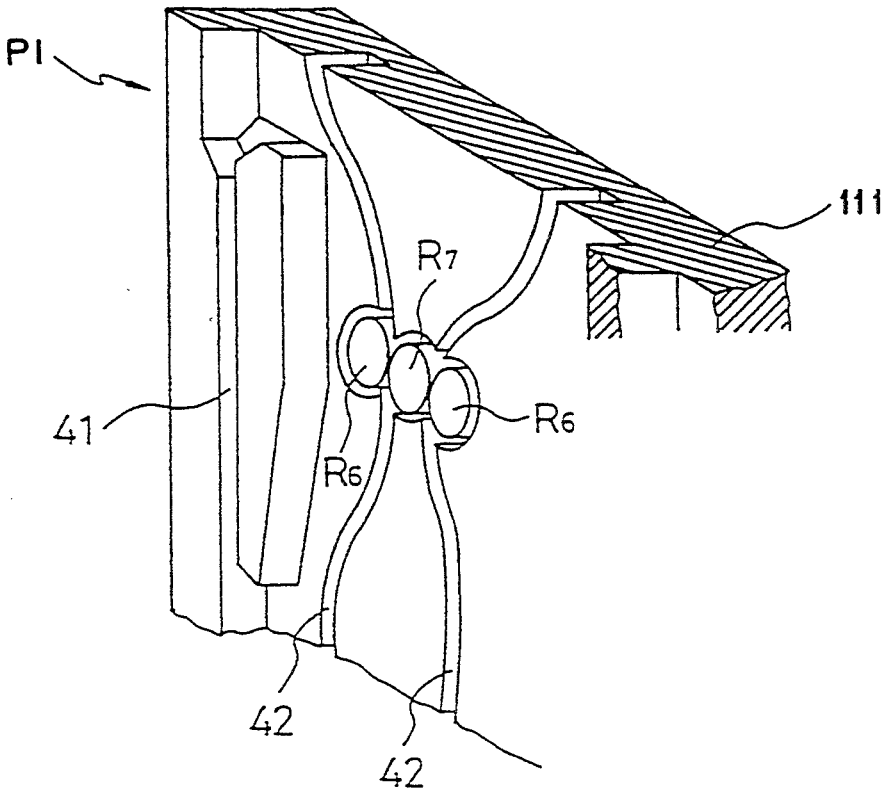
FIG. 6 is a perspective view specifically showing a short roller used in the third embodiment.

The present invention will now be described with reference to the attached drawings. FIGS. 1 through 3 show a first embodiment of the present invention, while FIGS. 4 through 6 show other embodiments of the present invention. In these embodiments, long color negative films are used as photosensitive material.

In developing apparatuses according to these embodiments, film supplied by a supply apparatus is transported by transport rollers so as to pass through a plurality of processing tanks which respectively contain a developing solution, a bleaching solution, a fixing solution, a washing solution, and a stabilizer. The films are then passed through a dryer to complete the processing.

FIG. 1 shows an upstream portion of a processing apparatus 10 according to the first embodiment in which a plurality of processing tanks are successively arranged in the order of the processing steps to be performed, as described above. In detail, a developing tank 1 containing a developing solution, a bleaching tank 2 containing a bleaching solution, a fixing tank 3 containing a fixing solution, and other processing tanks are disposed side by side in the order of the processing steps. Each tank extends in the vertical direction. In the following description, the emphasis will be on the structures of the developing tank 1 and the bleaching tank 2. A narrow film $F_1$ and a wide film $F_2$ (illustrated in FIG. 2) are transported as indicated by arrows A and B in FIG. 1 to be submerged in the processing solutions.

Disposed in the processing tanks 1 and 2 are transport racks 100 each of which is comprised of a pair of vertical walls 111, 111 or 112, 112, and three sets of rollers which are disposed between the vertical walls 111, 111 or 112, 112 at upper, intermediate and lower positions in the vertical direction and are rotatably supported thereby. Each of the upper roller sets and intermediate roller sets includes three rollers $R_1$, $R_{11}$ and $R_1$, and $R_2$, $R_{21}$ and $R_2$ in which adjacent rollers contact each other, while each of the lower roller sets includes four rollers $R_3$, $R_{31}$, $R_3$ and $R_3$. Among these rollers, rollers $R_{11}$, $R_{21}$ and $R_{31}$, which contact the remaining rollers in the respective roller sets are rotated by an unillustrated drive source so as to act as drive rollers. However, the combination of drive rollers is not limited to the above-described combination. A combination of two drive rollers $R_{11}$ and $R_{31}$, is possible. Further, one or more of rollers $R_1$, $R_2$ and $R_3$ can be used as drive rollers.

Each of the processing tanks 1 and 2 is provided with a pair of feed-in rollers $R_4$, $R_4$ for feeding films into a corresponding tank, and a pair of feed-out rollers $R_5$, $R_5$ for feeding films into a subsequent tank. Arcuate guide plates 12, 13 and 14 are disposed at a film supply portion indicated by arrow A, from which films to be processed are fed, and at locations between the feed-in roller $R_4$ and the roller $R_{11}$ of each processing tank, between the roller $R_{11}$ and the feed-out roller $R_5$ of each processing tank, and between the feed-out roller $R_5$ of each processing tank and the feed-in roller $R_4$ of the corresponding subsequent processing tank 2 or 3. The apparatus including the above-described serially arranged tanks, and the transport rollers and the guide plates, both arranged above the processing tanks, is completely covered by an unillustrated housing for preventing light from entering the apparatus.

The pair of vertical walls 111, 111 or 112, 112 of each of processing tanks 1, 2 has a pair of opposing surfaces in each of which a substantially linear groove 21 (illustrated by the broken line in FIG. 1) for guiding the narrow film $F_1$, and a curved groove 22 (illustrated by the chain line in FIG. 1) for guiding the wide film $F_2$ are formed. The grooves 21 are hereinafter referred to as "the narrow film guide grooves 21", while the grooves 22 are hereinafter referred to as "the wide film guide grooves 22". The narrow film guide grooves 21 and the wide film guide grooves 22 are formed such that both the grooves 21 and 22 extend along a tangential line which is perpendicular to the axes of two adjacent rollers in each roller set, and are separated from each other in regions between every two roller sets.

FIG. 2 is a perspective view of one of the vertical walls 111, 111 showing a guide portion PI for the narrow film $F_1$ which is provided on the vertical wall 111 at a location near the tangential line between two rollers. The guide portion PI is disposed at locations $P_1$, $P_2$, $P_3$ and $P_4$, as shown in FIG. 1. In detail, each guide portion is located on the narrow film guide grooves and on the downstream side of each roller set. Films $F_1$ and $F_2$ to be processed are fed by an unillustrated feed mechanism to the developing tank 1 along the common transport path for the films $F_1$ and $F_2$, which is illustrated by the broken line in FIG. 1. During transport, film $F_1$ or $F_2$ coming out from a certain pair of rollers is guided by the guide portion PI so that film $F_1$ or $F_2$ is securely nipped by a successive pair of rollers. Although the guide portion PI is provided in each processing tank at the locations $P_1$, $P_2$, $P_3$ and $P_4$ in this embodiment, the present invention is not limited to the arrangement in which the guide portion PI is provided on the downstream side of each roller set, and the number of the guide portions PI may be reduced. Further, the guide portion PI is also provided in vertical wall 112.

As shown in FIG. 2, at the guide portion PI, inclined surfaces 23 and 24 are provided on the narrow film guide grooves 21, the inclined surface 23 being sloped in the direction in which the films are transported, and the inclined surface 24 being sloped in the transverse direction of the films. A sectional view taken along line 3—3 of FIG. 2 is shown in FIG. 3. Accordingly, even in the case in which the leading edge of the narrow film $F_1$ deviates from the correct transport path and thereby contacts the inner side surface 111A of a vertical wall 111, the leading edge is forced by the inclined surface 24 to move in the direction of the arrows so that both side edges of the film $F_1$ are introduced into the pair of narrow film guide grooves 21.

Both side edges of the wide film $F_2$ are guided into the wide film guide grooves 22, which are separated from the narrow film guide grooves 21 on the downstream side of each roller set. Since the two opposing surfaces of the vertical walls 111, 111 or 112, 112 are not formed with other grooves separated by a distance larger than the distance between the wide film guide grooves 22, the direction of transport of the wide film $F_2$ does not deviate from the correct transport path. Further, since the wide film $F_2$ is guided by the wide film guide grooves 22 even at the locations where the film is nipped by rollers, the direction of transport can be easily changed. Accordingly, the wide film $F_2$ can be reliably branched from the common transport path and then transported along its own transport path even though its own transport path is curved. When the narrow film $F_1$ is transported, the lateral center of the film may deviate from the correct position. Even in such a case, the film $F_1$ can be reliably transported through the processing tanks, because the apparatus according to this embodiment has the above-described guide mechanism. In detail, the feed mechanism (not illustrated) feeds the films $F_1$ and $F_2$ to the development tank 1 such that the lateral centers of the films coincide with the lateral center of the rollers 4 (shown in FIG. 1), which do not guide the side edges of the films. The narrow films $F_1$ are guided by the guide portions PI provided at the above-mentioned locations so that the narrow films $F_1$ return to the correct transport path even when the films deviate from the correct transport path. This ensures the stable transport of the films.

As described above, the photosensitive material processing apparatus according to the present embodiment eliminates both the necessity of attaching leaders to films for their transport, and the necessity of a complicated width adjusting mechanism or similar mechanism. This shortens the processing time and decreases production costs of the apparatus due to its simple structure.

Although the first embodiment has been described using color negative films as an example of photosensitive materials, the present invention is not limited to color negative films and can be applied to other kinds of photosensitive materials such as color printing paper and monochrome printing paper.

FIG. 4 shows a second embodiment of the present invention. Similar to the first embodiment, a developing tank 1 containing a developing solution, a bleaching tank 2 containing a bleaching solution, a fixing tank 3 containing a fixing solution, and other processing tanks are disposed side by side in the order in which processing steps are performed. The transport rollers provided in the processing tanks, the rollers $R_4$ and $R_5$ disposed at locations above the processing tanks in which the lateral positions of films are not restricted, and the guide portions PI provided along the narrow film guide grooves 31 are the same as those in the first embodiment, including their positions.

In the first embodiment, the narrow film guide grooves 21 (illustrated by the broken line in FIG. 1) are substantially straight, whereas the wide film guide grooves 22 (illustrated by the chain line in FIG. 1) have a curved shape so as to be separated from the narrow film guide grooves 21. Therefore, the transport path for narrow films is not equal in length to the transport path for wide films, which produces a difference in the length of time during which the films stay in each of the processing tanks. To obviate this problem, conventional processing apparatuses use a controller for controlling the drive apparatus so as to control the speed of transport whereby the processing time of the wide films is made equal to the processing time of the narrow films. In this second embodiment, the narrow film guide grooves 31 and the wide film guide grooves 32 have symmetrical curved shapes so as to equalize the length of the narrow film guide grooves 31 and the length of the wide film guide grooves 32, and to separate them in regions between every two roller sets. In this embodiment, both narrow films and wide films can be processed in the same length of time without using a controller for controlling the drive apparatus.

FIG. 5 shows a third embodiment of the present invention. The processing apparatus according to this embodiment is the same as that in the second embodiment except that the intermediate set of rollers $R_2$, $R_{21}$ and $R_2$ provided in each of the processing tanks 1 and 2 is replaced with a pair of rollers $R_6$, $R_6$, a set of three rollers $R_6$, $R_7$ and $R_6$, and another pair of rollers $R_6$, $R_6$. These rollers have a short axial length and are formed in each of the vertical walls 111, 111 and 112, 112, so as to be embedded therein. The narrow film guide grooves 41 and the wide film guide grooves 42 are both curved to have the same length, as in the second embodiment. Therefore, no difference is produced in the processing time of the films.

FIG. 6 is a perspective view of one of the vertical walls showing the short rollers $R_6$, $R_7$ and $R_6$ provided at the intermediate portion of the wall. These short rollers are received in depressions of the walls such that their end surfaces are substantially flush with the inner surface of the vertical wall 111. Since these rollers are short rollers, the rollers contact films transported in the processing tanks only at both edges thereof which are outside of the image frames. The processing apparatus according to the third embodiment therefore has an advantage in that it prevents the formation of scratches on the image frames even in the case where dust adheres to the surface of a film when the surface of the film contacts the transport rollers.

What is claimed is:

1. A photosensitive material processing apparatus comprising:

a plurality of processing tanks serially arranged in an order in which processing is to be performed, and accommodating processing solutions respectively;

transport means for transporting an elongated photosensitive material so as to immerse said photosensitive material in each of said processing solutions; and guide means for guiding said photosensitive material transported by said transport means and having a plurality of guide members corresponding to a plurality of widths of photosensitive material, wherein said transport means is provided in each of said plurality of processing tanks and comprises a pair of wall portions which oppose each other, at least a portion of said wall portions being immersed in a processing solution accommodated in the corresponding processing tank, said transport means further comprising a plurality of transport rollers disposed between said pair of wall portions and axially supported by said pair of wall portions, and wherein said plurality of guide members comprise a plurality of grooves formed in said pair of wall portions.

2. A photosensitive material processing apparatus according to claim 1, wherein said plurality of transport rollers comprises nipping rollers for nipping the substantially intermediate portion of said photosensitive material in the transverse direction.

3. A photosensitive material processing apparatus according to claim 1, wherein said plurality of grooves are formed to have at least two different lengths.

4. A photosensitive material processing apparatus according to claim 1, wherein said plurality of grooves are formed to have the same length.

5. A photosensitive material processing apparatus according to claim 1, wherein said plurality of grooves are formed such that the plurality of transport paths of said photosensitive material merge at a merging portion, and separate into a plurality of grooves at a downstream side of said merging portion.

6. A photosensitive material processing apparatus according to claim 5 wherein at least three transport rollers of said plurality of transport rollers are provided at said merging portion, respective axial lengths of said at least three transport rollers being such that axial direction end surfaces of said at least three transport rollers are provided inwardly of outer surfaces of said wall portions.

7. A photosensitive material processing apparatus according to claim 1, wherein at least one guide member of said plurality of guide members has an inclined surface for adjusting the transverse position of each photosensitive material.

8. A photosensitive material processing apparatus according to claim 1, wherein said plurality of transport rollers comprises nipping rollers for nipping said photosensitive material at respective vicinities of the transverse end portions of said photosensitive material.

9. A photosensitive material processing apparatus comprising:

a plurality of processing tanks serially arranged in an order in which processing is to be performed, and accommodating processing solutions respectively;

transport means for transporting an elongated photosensitive material so as to immerse said photosensitive material in each of said processing solutions; and guide means for guiding said photosensitive material transported by said transport means and having a plurality of guide members corresponding to a plurality of widths of photosensitive material, wherein said transport means is provided in each of said plurality of processing tanks and comprises a pair of wall portions which oppose each other, at least a portion of said wall portions being immersed in a processing solution accommodated in the corresponding processing tank, said transport means further comprising a plurality of transport rollers disposed between said pair of wall portions and axially supported by said pair of wall portions, and wherein said plurality of transport rollers comprises nipping rollers for nipping said photosensitive material at respective vicinities of the transverse end portions of said photosensitive material.

10. A photosensitive material processing apparatus comprising:

a plurality of processing tanks serially arranged in an order in which processing is to be performed and accommodating processing solutions respectively;

transport means provided in each of said plurality of processing tanks for transporting elongated photosensitive material so as to immerse said photosensitive materials into corresponding processing solutions, and said transport means has a pair of wall portions which oppose each other, at least parts of which are immersed in said processing solution, and has a plurality of transport rollers disposed between said pair of wall portions and axially supported by said pair of wall portions; and a plurality of grooves formed in said pair of wall portions, and provided to correspond to a plurality of widths of said photosensitive materials, and guiding said photosensitive material transported by said transport means.

11. A photosensitive material processing apparatus according to claim 10, wherein said plurality of grooves are formed to have at least two different lengths.

12. A photosensitive material processing apparatus according to claim 11, wherein said plurality of transport rollers has first nipping rollers for nipping the substantially intermediate portion of said photosensitive material in the transverse direction.

13. A photosensitive material processing apparatus according to claim 10, wherein said plurality of grooves are formed to have the same length.

14. A photosensitive material processing apparatus according to claim 14, wherein said plurality of transport rollers has first nipping rollers for nipping the substantially intermediate portion of said photosensitive material in the transverse direction.

15. A photosensitive material processing apparatus according to claim 14, wherein said plurality of transport rollers has second nipping rollers for nipping said photosensitive material at respective vicinities of the transverse end portions of said photosensitive material.

16. A photosensitive material processing apparatus according to claim 10, wherein said plurality of grooves are formed such that the plurality of transport paths of said photosensitive material merge at a merging portion, and separate into a plurality of grooves at a downstream side of said merging portion.

17. A photosensitive material processing apparatus according to claim 16, wherein at least three transport rollers of said plurality of transport rollers are provided at said merging portion, respective axial lengths of said at least three transport rollers being such that axial direction end surfaces of said at least three transport rollers are provided inwardly of outer surfaces of said wall portions.

18. A photosensitive material processing apparatus according to claim 10, wherein at least one guide member of said plurality of guide members has an inclined surface for adjusting the transverse position of each photosensitive material.

* * * * *